United States Patent [19]

Kleykamp

[11] Patent Number: 4,840,126

[45] **Date of Patent: * Jun. 20, 1989**

[54] RAILROAD HATCH COVER HAVING AN INTEGRAL HOLDDOWN BAR THEREFOR

[76] Inventor: Donald L. Kleykamp, 6014 Gothic Pl., Dayton, Ohio 45459

[ * ] Notice: The portion of the term of this patent subsequent to Jul. 29, 2003 has been disclaimed.

[21] Appl. No.: 89,464

[22] Filed: Aug. 26, 1987

Related U.S. Application Data

[60] Continuation of Ser. No. 856,899, Apr. 28, 1986, abandoned, which is a division of Ser. No. 459,069, Jan. 19, 1983, Pat. No. 4,602,569.

[51] Int. Cl.[4] ..... B61D 39/00

[52] U.S. Cl. ..... 105/377

[58] Field of Search ..... 105/377; 49/489

[56] References Cited

U.S. PATENT DOCUMENTS

| | | | |
|---|---|---|---|
| 1,209,265 | 12/1916 | Crowell | 105/377 |
| 2,306,990 | 12/1942 | Essl | 49/493 X |
| 3,082,022 | 3/1963 | Moore | 285/330 X |
| 3,126,591 | 3/1964 | Hamilton | 49/489 |
| 3,407,536 | 10/1968 | Nystrom | 49/489 X |
| 3,605,639 | 9/1971 | Ingram | 105/377 |
| 3,645,573 | 2/1972 | Strang | 292/241 |
| 3,664,270 | 5/1972 | Stark et al. | 292/256.5 X |
| 3,796,168 | 3/1974 | Zeller | 105/377 |
| 4,065,539 | 12/1977 | Nadel | 264/273 |
| 4,239,008 | 12/1980 | Conlon | 105/377 |
| 4,320,161 | 3/1982 | Redman | 52/716 X |
| 4,378,742 | 4/1983 | Saylor et al. | 292/256.5 X |
| 4,602,569 | 7/1986 | Kleykamp | 105/377 |

FOREIGN PATENT DOCUMENTS

| | | | |
|---|---|---|---|
| 440040 | 12/1935 | United Kingdom | 264/318 |

*Primary Examiner*—Leonard E. Smith
*Assistant Examiner*—Leonard P. Walnoha
*Attorney, Agent, or Firm*—Joseph V. Tassone

[57] ABSTRACT

A hatch cover arrangement for a railroad car or the like and method of making the same as well as a railroad car utilizing such hatch cover arrangement are provided, the hatch cover arrangement comprising the combination of a hatch cover and a holddown bar for the hatch cover. The holddown bar has opposed ends one of which is adapted to be pivotally mounted to the car and the other of which is adapted to be releasably latched to the car while a medial portion thereof intermediate the opposed ends thereof extends transversely across the hatch cover, the holddown bar and the hatch cover comprising a one-piece homogeneous member formed of polymeric material.

7 Claims, 7 Drawing Sheets

RAILROAD HATCH COVER HAVING AN INTEGRAL HOLDDOWN BAR THEREFOR

CROSS REFERENCE TO RELATED APPLICATIONS

This application is a continuation patent application of its copending parent patent application, Ser. No. 856,899, filed Apr. 28, 1986, now abandoned, which, in turn, is a divisional patent application of its copending parent patent application, Ser. No. 459,069, filed Jan. 19, 1983, not U.S. Pat. No. 4,602,569.

BACKGROUND OF THE INVENTION

1. Field of the Invention

This invention relates to an improved combination of a hatch cover for a railroad car and a holddown bar for the hatch cover and to a method of making such combination as well as to a railroad car utilizing such combination of the hatch cover and holddown bar.

2. Prior Art Statement

It is known to applicant to provide a combination of a hatch cover for a railroad car and a holddown bar for the hatch cover, the holddown bar having opposed ends one of which is adapted to be pivotally mounted to the car and the other of which is adapted to be releasably latched to the car while a medial portion thereof intermediate the opposed ends extends transversely across the hatch cover.

For example, see FIGS. 1–12 of this application which disclose part of the subject matter of the copending patent application, Ser. No. 412,416, filed Aug. 27, 1982, and wherein each holddown bar operates independently of the operation of its respective hatch cover.

SUMMARY OF THE INVENTION

It is one feature of this invention to provide an improved combination of a hatch cover for a railroad car and a holddown bar for the hatch cover.

In particular, it was found according to the teachings of this invention that the hatch cover for a railroad car could be made integral with one or more of the holddown bars for that hatch cover so that the hatch cover and holddown bars would be a one-piece homogeneous member formed of polymeric material and would thereby not require separate operating parts for the hatch cover and the holddown bars therefor.

For example, one embodiment of this invention provides an improved combination of a hatch cover for a railroad car and a holddown bar for the hatch cover, the holddown bar having opposed ends one of which is adapted to be pivotally mounted to the car and the other of which is adapted to be releasably latched to the car while a medial portion thereof intermediate the opposed ends thereof extends transversely across the hatch cover. The holddown bar and the hatch cover comprise a one-piece homogeneous member formed of polymeric material.

Accordingly, it is an object of this invention to provide an improved combination of a holddown bar and a hatch cover for a railroad car or the like, the combination of this invention having one or more of the novel features of this invention as set forth above or hereinafter shown or described.

Another object of this invention is to provide an improved method of making such a combination, the method of this invention having one or more of the novel features of this invention as set forth above or hereinafter shown or described.

Another object of this invention is to provide a railroad car having the improved combination of this invention, the railroad car of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
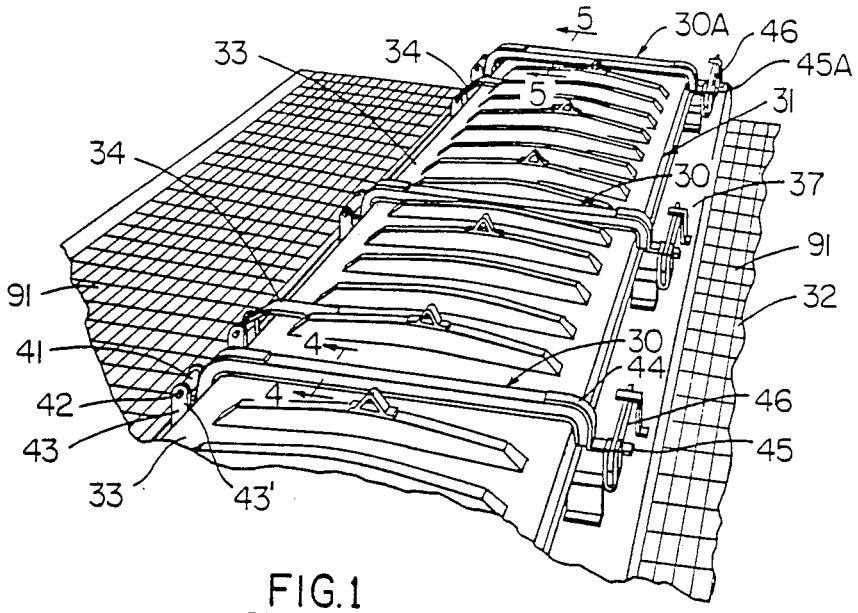
FIG. 1 PRIOR ART
FIG. 1 is a fragmentary top perspective view of a railroad car having holddown bars for the hatch covers thereof, FIG. 1 illustrating prior art holddown bars.

While the various features of this invention are hereinafter illustrated and described as providing a hatch cover arrangement for a certain type of railroad car, it is to be understood that the various features of this invention can be utilized singly or in any combination thereof to provide a hatch cover arrangement for other structures as desired.

Therefore, this invention is not to be limited to only the embodiments illustrated in the drawings, because the drawings are merely utilized to illustrate one of the wide variety of uses of this invention.

It is believed that in order to fully describe the various features of this invention, a detailed disclosure of the prior art structure should be first set forth.

Figure 2:
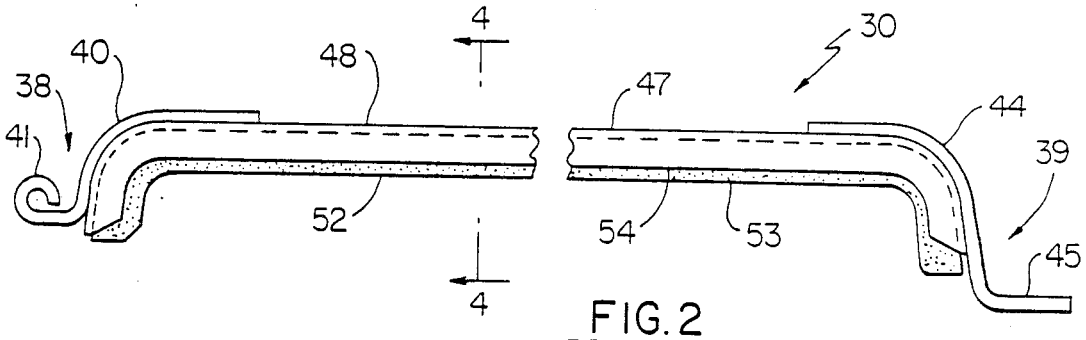
FIG. 2 PRIOR ART
FIG. 2 is an enlarged side view of one of the prior art holddown bars of FIG. 1.
Figure 3:
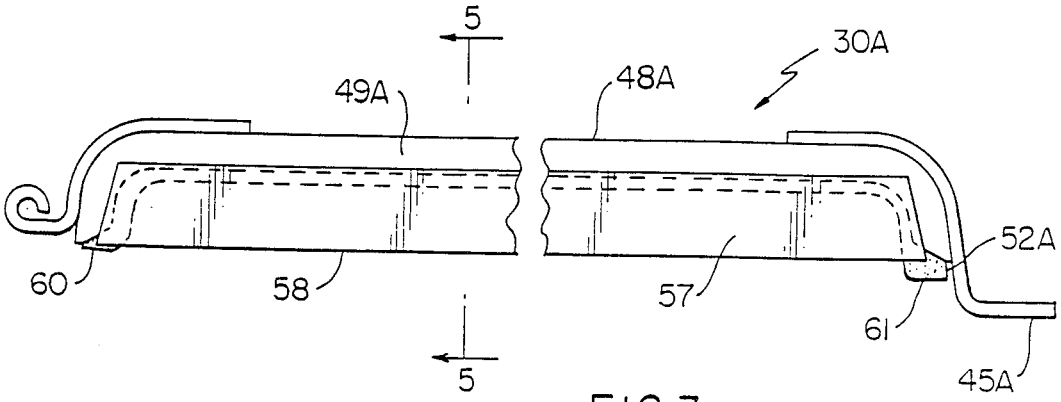
FIG. 3 PRIOR ART
FIG. 3 is an enlarged side view of another of the prior art holddown bars of FIG. 1.
Figure 4:
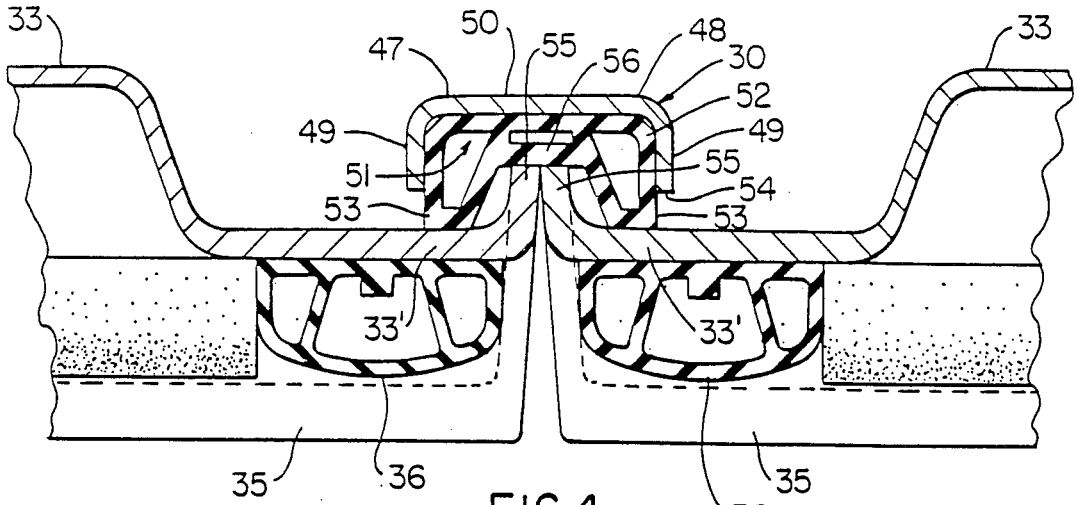
FIG.4 PRIOR ART
FIG. 4 is an enlarged fragmentary cross-sectional view taken on line 4—4 of FIG. 2 as well as on line 4—4 of FIG. 1.
Figure 5:
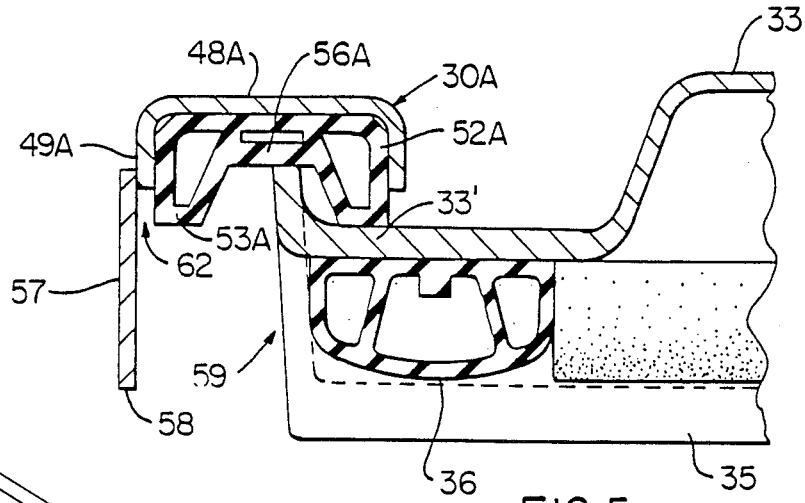
FIG.5 PRIOR ART
FIG. 5 is an enlarged fragmentary cross-sectional view taken on line 5—5 of FIG. 3 as well as on line 5—5 of FIG. 1.

Accordingly, referring now to FIGS. 1–5, one prior known holddown bar for a hatch cover of a railroad car is generally indicated by the reference numeral 30 in FIGS. 1, 2 and 4 while another prior known holddown bar is generally indicated by the reference numeral 30A in FIGS. 1, 3 and 5, the prior known holddown bars 30 and 30A being illustrated in FIG. 1 as holding closed the hatch cover means 31 of a conventional railroad car 32.

The hatch cover means 31 of the railroad car 32 comprises two like hatch covers 33 disposed in aligned relation and each being pivotally mounted to the car 32 by hinge means 34 in a manner conventional in the art.

Each hatch cover 33 has a peripheral flange means 35 carrying sealing gasket means 36 which are adapted to be disposed in sealing relation against the hatch opening flange 37 and be held in sealing engagement therewith by the holddown bars 30 and 30A in a manner well known in the art to fully close the hatch opening (not shown) in the top of the railroad car 32.

The prior known holddown bar 30 has opposed ends 38 and 39 with the end 38 comprising a metal plate 40 that is formed to define a tubular part 41 that is adapted to be pivotally mounted to a pivot pin means 42 of a bracket means 43 carried by the railroad car 32 in a manner well known in the art whereby the holddown bars 30 are adapted to pivot on the pivot pin means 42 and between the upstanding side flanges 43' of the bracket means 43.

Each prior known holddown bar 30 has the other end thereof formed from a metal plate 44 so shaped that the same defines a toe or latch plate 45 which is adapted to be releasably latched to the car 32 by suitably latch member 46 extending over the same as illustrated in FIG. 1 in a manner well known in the art whereby a medial portion 47 of the holddown bar 30 will extend across the respective hatch cover 33 or covers 33 to sealingly engage thereagainst and hold the respective hatch cover 33 or covers 33 in sealing relation against the hatch opening flange 37 of the railroad car 32 in a manner well known in the art.

The medial portion 47 of each holddown bar 30 comprises a metal channel member 48 having a pair of spaced parallel legs 49 and a cross member 50 that define a channel 51 which receives a resilient sealing gasket means 52 therein which has side portions 53 that extend outboard of the bottom edges 54 of the legs 49 of the U-shaped channel member 48 as illustrated in FIGS. 2 and 4 so as to sealingly engage directly against the hatch cover 33 or covers 33. For example, FIG. 4 illustrates the holddown bar 30 spanning and engaging the adjacent upstanding end flanges 55 at the adjacent ends 33' of the hatch covers 33 with a central section 56 of the gasket 52 while the side portions 53 of the gasket 52 sealingly engage against the respective covers 33 inboard of the flanges 55 thereof as illustrated in FIG. 4. In this manner, not only are the adjacent ends 33' of the two hatch covers 33 held in a sealing closed condition against the hatch opening flange 37 by the holddown bar 30 of FIG. 4, but also the gasket 52 of the holddown bar 30 seals the adjacent flanges 55 to each other.

As illustrated in FIG. 1, at least one other holddown bar 30 is provided on the railroad car 32 for each hatch cover 33 and is disposed intermediate the opposed ends 33' of the respective hatch cover 33 to engage against such hatch cover 33 and hold the same in its closed condition against the hatch opening flange 37.

The metal end plates 40 and 44 that define the opposed ends 38 and 39 of each holddown bar 30 are secured to the metal channel member 48, such as by welding or the like, and the sealing gasket means 52, which is formed of rubber or the like, is secured in the channel 51 of the channel member 48 by a suitably adhesive or the like. The surfaces of the metal parts of the holddown bar can be provided with protective coatings or the like.

Each holddown bar 30A is formed in substantially the same manner as the holddown bar 30 previously described whereby like parts are indicated by like reference numerals followed by the reference letter "A".

As illustrated in FIGS. 3 and 5, each holddown bar 30A is formed identical to the holddown bar 30 previously described except that the same has a metal side plate 57 welded to the particular leg 49A of the channel member 48A so as to have its lower edge 58 extend closely adjacent the hatch flange 37 of the car 32 as illustrated in FIG. 5 so as to tend to protect the particular end 33' of the hatch cover 33 that is exposed to the elements at each end of the railroad car 32 in the area of the reference numeral 59 in FIG. 5 whereby the two end holddown bars 30A for each railroad car 32 have the side plates 57 on different legs 49 of their respective channel member 48. Such side plate 57 is hereinafter referred to as a "rain shield" but it is of course to be understood that the same shields the protected hatch even from other elements of the weather than just rain.

However, it was found according to the teachings of the invention set forth in the copending patent application, Ser. No. 412, 416, filed Aug. 27, 1982, that not only are the opposed ends 60 and 61 of the gasket means 52A of each holddown bar 30A exposed to the elements as illustrated in FIG. 3 even though the side plate 57 is being utilized, but also the sealing gasket means 52A of each holddown bar 30A as illustrated in FIG. 5 has an area in the region of the reference numeral 62 subjected to wind, ice, snow, etc. which tend to start gasket tear and, thus, early wear out of the sealing gasket means 52A. In addition, it is believed that the sharp metal edges on the U-shaped channel member 48A tend to cause cutting of the gasket 52A and, thus, also early wear out thereof.

It can readily be seen from FIG. 1 that the hatch covers 33 are adapted to be latched in the closed position by the holddown bars 30 and 30A having the latch toes 45 and 45A thereof held in the latched position by the latches 46 whereby the sealing gasket means 36 of the covers 33 are held in sealing relation against the hatch opening flange 37 until it is desired to open the hatch covers 33.

In particular, in order to open a particular hatch cover 33, the latches 46 for the holddown bars 30 and 30A for that particular hatch cover 33 are opened so that the holddown bars 30 and 30A can be pivoted on their pivot ends 38 at the bracket means 43 in a manner to be out of the way of the particular hatch cover 33 so that that particular hatch cover 33 can be opened on its hinge structure 34 in a manner conventional in the art.

Figure 6:
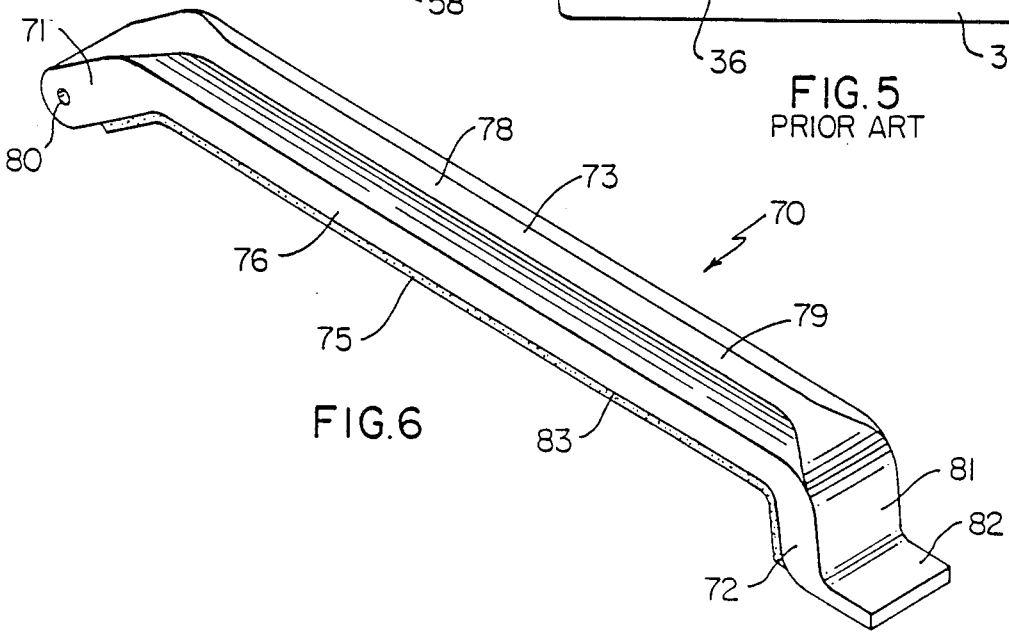
FIG. 6 is a top perspective view of one of the improved prior known holddown bars of the invention of the copending patent application, Ser. No. 412,416, filed Aug. 27, 1982.

As previously stated, it was found according to the teachings of the invention set forth in the copending patent application, Ser. No. 412,416, filed Aug. 27, 1982, that the prior known substantially all metal holddown bars 30 and 30A can be replaced by the uniquely formed holddown bars of that invention that are generally indicated by the reference numeral 70 in FIG. 6 and 70A in FIG. 11, the holddown bars 70 of FIG. 6 to replace the intermediate holddown bars 30 of FIG. 1 and the holddown bars 70A of FIG. 11 to replace the holddown bars 30A of FIG. 1 as will be apparent hereinafter whereby this copending patent application, Ser. No. 412,416, filed Aug. 27, 1982 is being incorporated into this disclosure by this reference thereto. However, sufficient details of the holddown bars of such copending application will now be described in this application in order to fully understand the improved features of this invention.

In particular, the holddown bars 70 and 70A respectively have opposed ends 71, 72 and 71A, 72A integrally and respectively interconnected together by medial portions 73 and 73A, the medial portions 73 and 73A, as well as at least part of the respective opposed ends 71, 72 and 71A, 72A, being so constructed that the same define channels 74 and 74A therein that receive the resilient sealing gasket means 75 and 75A which are disposed between pairs of spaced apart substantially parallel legs 76 and 76A.

The holddown bars 70 and 70A are made from a relatively rigid polymeric material and are formed, such as by molding, so that the opposed ends 71, 72 and 71A, 72A, as well as the medial portions 73 and 73A thereof, respectively comprise one-piece members that form the unique configurations illustrated in the drawings.

In particular, the medial portions 73 and 73A of the holddown bars 70 and 70A are substantially straight with the top portions 78 and 78A thereof each having a substantially trapezoidal cross-sectional configuration so as to provide substantially streamlined top surfaces 79 and 79A of the respective holddown bars 70 and 70A, as well as added strength to the medial portions 73 and 73A thereof.

Figure 8:
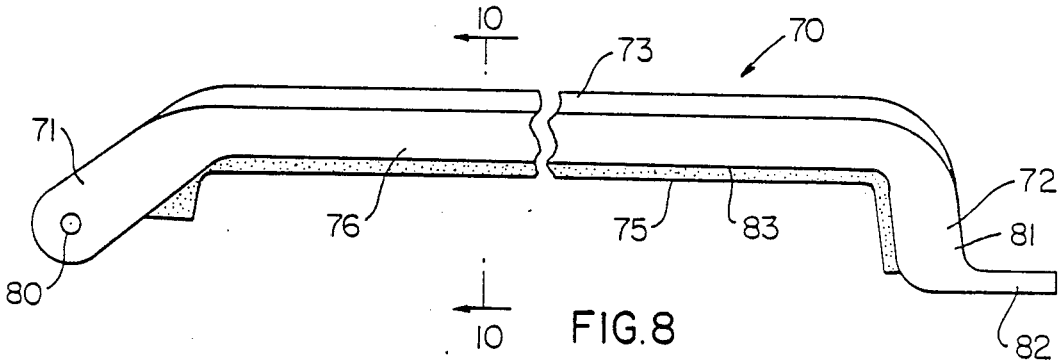
FIG. 8 is a side view of the holddown bar of FIG. 7.
Figure 9:
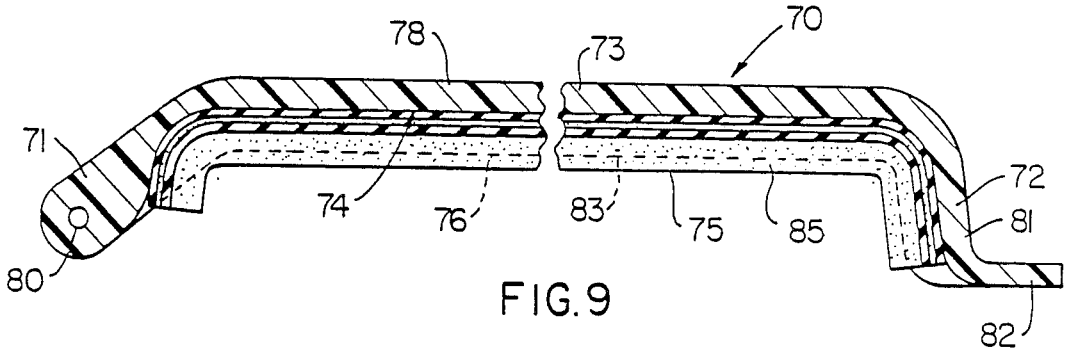
FIG. 9 is a cross-sectional view taken on line 9—9 of FIG. 7.
Figure 11:
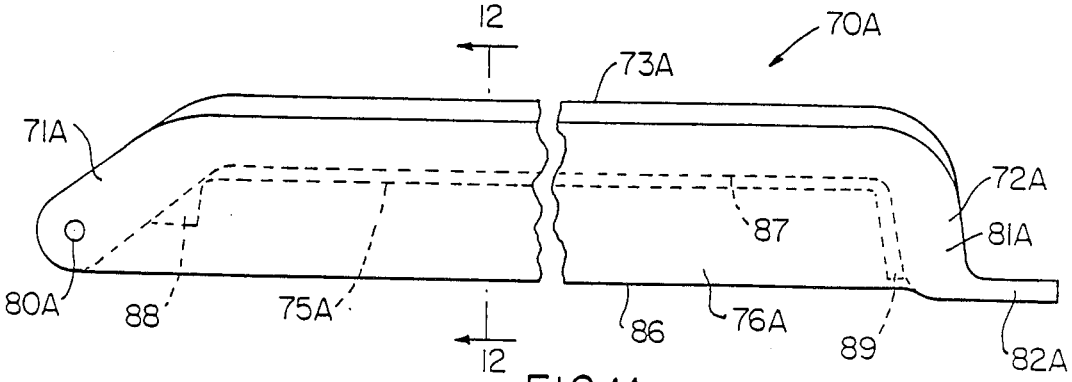
FIG. 11 is a side view of another improved prior known holddown bar of the invention of the aforementioned copending patent application.

The ends 71 and 71A of the respective holddown bars 70 and 70A are substantially straight and are respectively disposed at obtuse angles relative to the respective medial portions 73 and 73A as illustrated respectively in FIGS. 8 and 11.

In this manner, the ends 71 and 71A of the holddown bars 70 and 70A respectively have the same width as the pair of legs 76 and 76A as well as provide relatively large masses of material to have the respective pivot holes 80 and 80A passing therethrough for respectively receiving the pivot pins 42 of the bracket means 43 of the railroad car 32 when the same are utilized to replace the holddown bars 30 and 30A as previously described.

Figure 7:
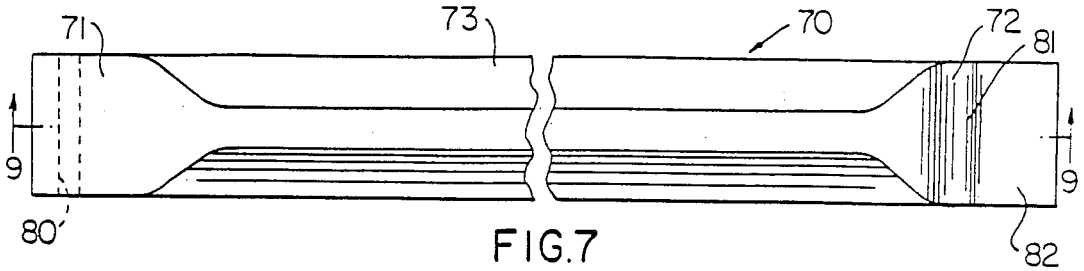
FIG. 7 is a top view of the holddown bar of FIG. 6.

The other ends 72 and 72A of the respective holddown bars 70 and 70A are substantially L-shaped and are defined by a pair of legs 81, 82 and 81A, 82A that join each other substantially at a right angle while the legs 81 and 81A respectively join the medial portions 73 and 73A substantially at right angles as illustrated respectively in FIGS. 8 and 11. The ends 72 and 72A are substantially the same width as the ends 71 and 71A previously described whereby the overall top view configurations of the holddown bars 70 and 70A are substantially rectangular as illustrated in FIG. 7.

Figure 10:
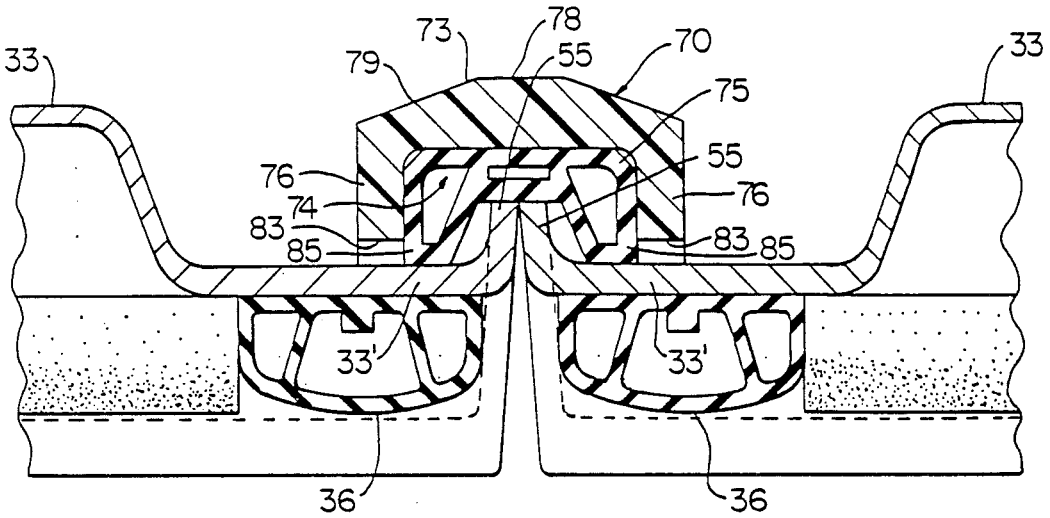
FIG. 10 is an enlarged fragmentary cross-sectional view taken on line 10—10 of FIG. 8 and illustrates the holddown bar in combination with hatch covers in a manner similar to FIG. 4.
Figure 12:
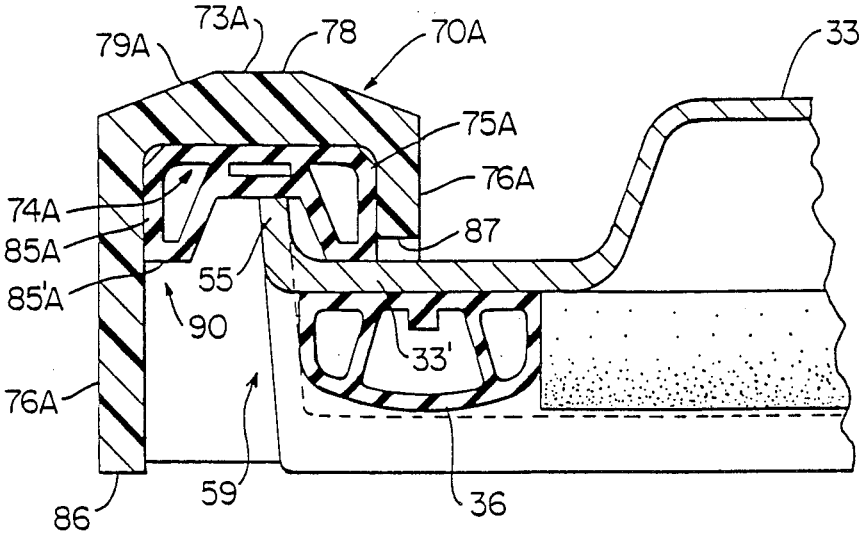
FIG. 12 is an enlarged fragmentary cross-sectional view taken on line 12—12 of FIG. 11 and illustrates the holddown bar in combination with a hatch cover in a manner similar to FIG. 5.

As illustrated in FIG. 10, the legs 76 of the holddown bar 70 respectively have bottom edges 83 which are disposed substantially coplanar with each other while the side portions 85 of the gasket means 75 extend outboard of the end edges 83 whereas in contrast the bottom edges 86 and 87 of the legs 76A of the holddown bar 70A are disposed in offset relation so that the bottom edge 86 of the longer leg 76A will extend closely adjacent the hatch opening flange 37 of the railroad car 32 as illustrated in FIG. 12 to protect the end area 59 of the adjacent end 33' of the hatch cover 33 in a believed to be more effective manner than the side palte 57 of the holddown bar 30A previously described whereby the longer leg 76A comprises a "rain shield".

In particular, it can readily be seen in FIG. 11 that the longer leg 76A has its bottom edge 86 disposed so that the same fully protects the opposed end portions 88 and 89 of the gasket means 75A whereas it can readily be seen in FIG. 3 that the opposed ends 60 and 61 of the gasket means 52A are exposed to the elements below the bottom edge 58 of the side plate 57 thereof.

In addition, it can readily be seen in FIG. 12 that the longer leg 76A of the holddown bar 70A is fully disposed against the sealing gasket means 75A all the way to the bottom edge 85'A of the adjacent portion 85A thereof so that wind, dirt, sleet, etc. cannot enter between the longer leg 76A and the gasket means 75A in the region of the reference numeral 90 whereas in contrast it can readily be seen in FIG. 5 that wind, dirt, sleet, etc. can enter into the region indicated by the reference numeral 62 to attack the lower free end 53A of the sealing gasket means 52A to begin a tear area therein as previously described.

As previously stated, the holddown bars 70 and 70A can be formed from any suitable relatively rigid polymeric material that can be molded into the configuration illustrated and the gasket means 75 and 75A can be subsequently and respectively adhesively secured in the channels 74 and 74A to perform a sealing function with the flanges 55 of the hatch covers 33 as well as against points thereon inboard of the flanges 55 as illustrated respectively in FIGS. 10 and 12.

For example, the relatively rigid polymeric material for forming the holddown bars 70 and 70A can be an ultra high molecular weight synthetic plastic material, such as nylon, polyethylene, urethane, etc., having a molecular weight of between two million and six million. For example, such an ultra high molecular weight polyethylene material and a method of molding the same is disclosed in the U.S. Pat. to Cooper et al, No. 4,238,039 whereby this patent is being incorporated into this disclosure by this reference thereto. Also, such polymeric material for the holddown bars 70 and 70A could be reinforced, such as is disclosed in this patent to Cooper et al or in the manner set forth in the copending patent application, Ser. No. 456,154, filed Jan. 6, 1983 (Dayco Corporation Docket No. 82–84) whereby this copending patent application is being incorporated into this disclosure by this reference thereto.

Accordingly, it can be seen that it is a relatively simple method to form the holddown bars 70 and 70A, such as by a simple molding operation, so that the same are substantially one-piece members that readily replace the holddown bars 30 and 30A of the railroad car 32 illustrated in FIG. 1 as the ends 71 and 71A thereof readily permit the same to be pivotally mounted on the pivot pins 42 of the brackets 43 and the legs 82 and 82A of the ends 72 and 72A readily accept the latch means 46 to permit latching of the holddown bars 70 and 70A with their medial portions 73 and 73A extending across the hatch covers 33 in such a manner that the sealing gasket means 75 and 75A thereof will seal and hold against the hatch covers 33 so that their respective sealing gasket means 36 will readily seal against the hatch opening flange 37 in the manner previously described.

However, it has been found that the holddown bars 70 and 70A are approximately sixty percent lighter than their steel counterparts 30 and 30A whereby a weight gain advantage of approximately 35 pounds per railroad car 32 is provided when the holddown bars 70 and 70A are substituted for the holddown bars 30 and 30A and such railroad car 32 had two holddown bars 30A and three holddown bars 30.

It is also believed that the holddown bars 70 and 70A are four times more wear resistant than the stainless steel counterpart holddown bars 30 and 30A.

Since the holddown bars 70 and 70A have less weight than their steel counterparts 30 and 30A, it is believed that the holddown bars 70 and 70A will not overload their respective gasket means 75 and 75A, as well as the gasket means 36 of the hatch covers 33, so as to permit the gasket means to maintain their sealing resilience for a longer period of time.

In addition to the chemical resistance and no-rust properties of the polymeric material of the holddown bars 70 and 70A, the polymeric material thereof is compatible with the plastic material that normally forms the hatch covers 33. This is particularly important because it has been found that as railroad cars 32 vibrate, twist and torque, the weight and pressure of a steel holddown bar, with its alien physical properties, can cause undue wear and cracks in the hatch covers 33. Since hatch cover replacements are costly, it is believed that by utilizing the holddown bars 70 and 70A, since the same have substantially the same expansion, contraction and mechanical characteristics as the hatch covers 33, a major source of stress and wear on the hatch covers 33 will be eliminated.

Since the operation of the holddown bars 70 and 70A are substantially the same as the holddown bars 30 and 30A previously described, it is deemed unnecessary to further describe the operation of the holddown bars 70 and 70A except to state that same can readily replace the holddown bars 30 and 30A.

When the holddown bars 70 and 70A are formed of the aforementioned ultra high molecular weight nylon, and such material was presently the preferred material for the holddown bars 70 and 70A, such material will provide the following characteristics among others: high tensile strength for structural rigidity; maintains its strength over a wide temperature range; heat distortion only occurs at temperatures over 400° F.; has outstanding wear resistance; is approximately seven times lighter than most metals; has excellent chemical resistance; has self-extinguishing flamability characteristics; is UV resistant; is self-lubricating, such as in the hinge area that is indicated by the reference numerals 42, 43 in FIG. 1; does not rust; and provides no damage to the running boards of the railroad car 32 which are indicated by the reference numeral 91 in FIG. 1.

Therefore, it can be seen that each of the holddown bars of the aforementioned copending patent applications can comprise a one-piece member formed of relatively rigid polymeric material and having or not having reinforcing means therein as desired.

As previously stated, it is a feature of this invention to provide an improved hatch cover arrangement or combination wherein the same has the hatch cover and at least one of the holddown bars thereof formed as a one-piece homogeneous member formed of polymeric material so that the holddown bar for such hatch cover need not be a separate operating part therefor as provided by each of the hatch cover arrangements previously described.

Figure 13:
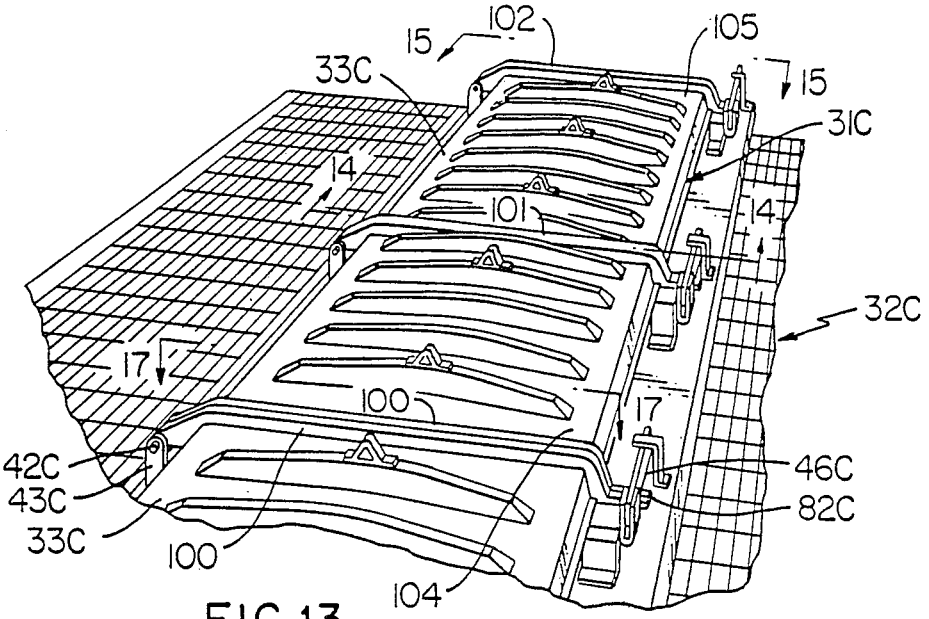
FIG. 13 is a view similar to FIG. 1 and illustrates a railroad car having the improved hatch cover arrangement or combination of this invention.

In particular, reference is now made to FIG. 13 wherein an improved hatch cover arrangement or combination for a railroad car 32C is generally indicated by the reference numeral 31C and parts thereof similar to the hatch covers and holddown bars therefor previously described are indicated by like reference numerals followed by the reference letter "C".

As illustrated in FIG. 13, the hatch cover combination or arrangement 31C of this invention comprises two like hatch covers 33C disposed in aligned relation with each hatch cover 33C having integral holddown bars 100, 101 and 102 each being formed as a one-piece member with the respective hatch cover 33C and being formed of the same polymeric material as the respective hatch cover 33C so that the holddown bars 100, 101 and 102 are homogeneous with the respective hatch cover 33C.

Each holddown bar 100, 101 and 102 has a hinge opening 80C passing through the end 71C thereof to respectively receive a pivot pin 42C of a hinge means 43C of the railroad car 32C that carries the hatch cover means 31C of this invention. Because the holddown bars 100, 101 and 102 of this invention are integral and one-piece with their respective hatch cover 33C so that the holddown bars 100, 101 and 102 do not move relative to the respective hatch cover 33C, the previously described hinges 34 of the hatch covers 33 previously described are eliminated because the holddown bars 100, 101 and 102 of this invention provide the sole hinge means for the hatch cover 31C. However, it is to be understood that additional hinge means, similar to the hinges 34 previously described, can be utilized if desired.

Figure 17:
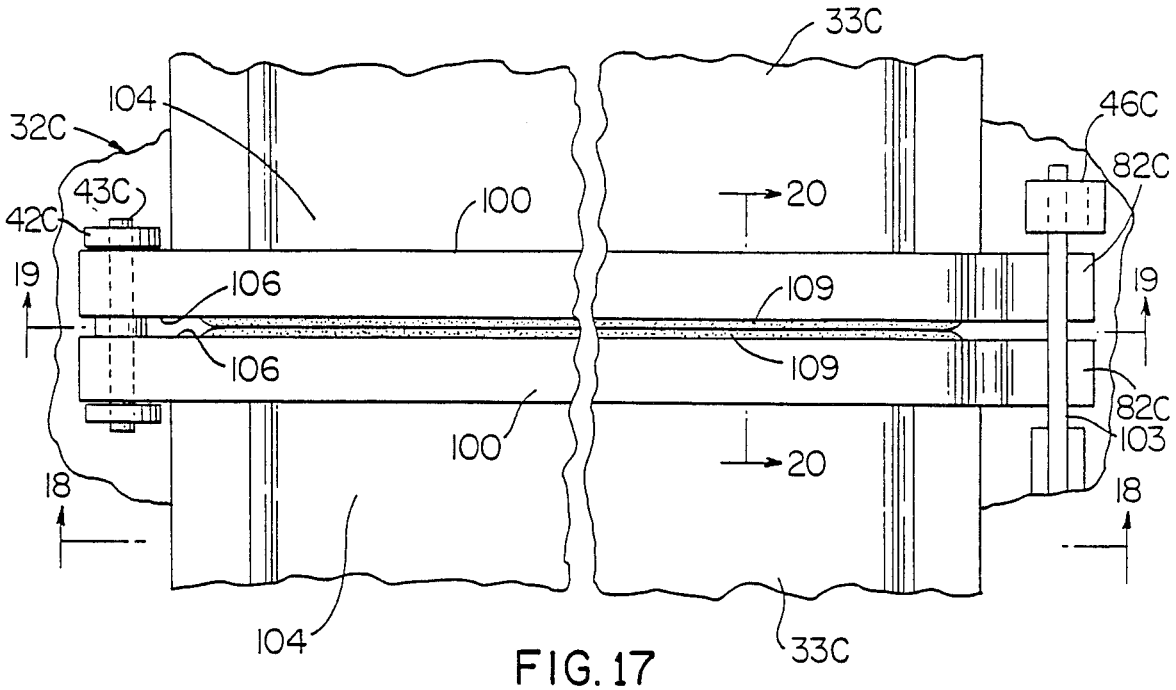
FIG. 17 is an enlarged fragmentary top view of a portion of the hatch cover arrangement of FIG. 13 and is taken in the direction of the arrows 17—17 of FIG. 13.
Figure 18:
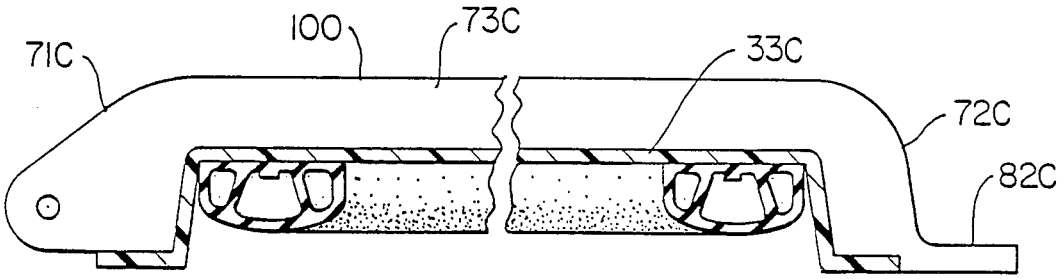
FIG. 18 is a fragmentary cross-sectional view taken on line 18—18 of FIG. 17.

Each holddown bar 100, 101 and 102 of each hatch cover 33C has its other end 72C provided with the latchable toe 82C against which and over which a latch bar of the latch means 46C is adapted to be disposed in the manner illustrated in FIG. 13, such as by the latch bar 103 in FIG. 17, in order to hold the particular hatch cover 33C in its closed position in a manner similar to the hatch covers 33 previously described.

The holddown bar 100 for its respective hatch cover 33C is disposed at the end 104 of the respective hatch cover 33C while the holddown bar 102 is disposed at the other end 105 thereof, the holddown bar 101 being disposed intermediate the opposed ends 104 and 105 of the respective hatch cover 33C.

Figure 14:
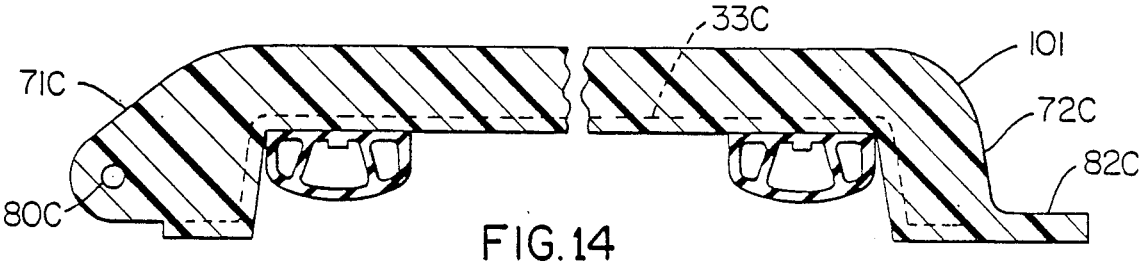
FIG. 14 is an enlarged cross-sectional view of the hatch cover arrangement of FIG. 13 and is taken on the line 14—14 of FIG. 13.
Figure 15:
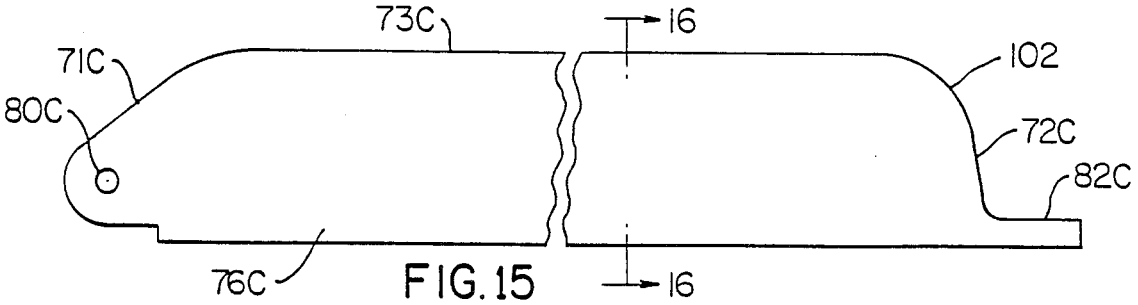
FIG. 15 is an end view of the hatch cover arrangement of FIG. 13 and is taken in the direction of the arrows 15—15 of FIG. 13.
Figure 16:
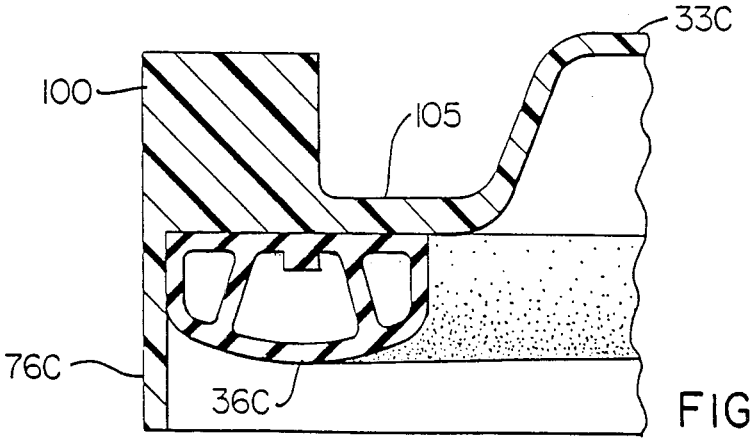
FIG. 16 is an enlarged fragmentary cross-sectional view taken on line 16—16 of FIG. 15.
Figure 20:
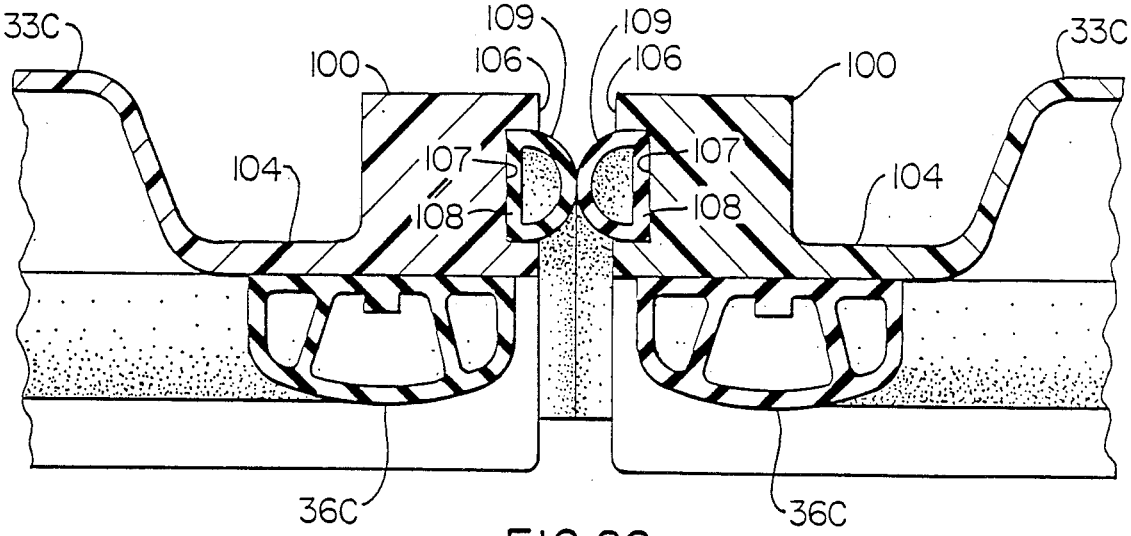
FIG. 20 is an enlarged fragmentary cross-sectional view taken on line 20—20 of FIG. 17.

Each holddown bar 100, 101 and 102 has a substantially thickened medial portion 73C interconnecting together the opposed ends 71C and 72C thereof as illustrated respectively in FIGS. 14, 16 and 20, each holddown bar 100, 101 and 102 being shaped substantially the same as the holddown bars 70 previously described with the holddown bar 102 for the end 105 of the hatch cover 33C having an integral rain shield portion 76C for protecting the gasket 36C that is carried by the end 105 of the hatch cover 33C for the reasons previously set forth in connection with the holddown bar 70A previously described.

The holddown bar 100 at the end 104 of each hatch cover 33C is provided with a substantially flat face 106 that will face the flat face 106 of the hatch cover 33C aligned therewith when the same are disposed in their closed condition as illustrated in FIGS. 17 and 20.

Each flat face 106 of each holddown bar 100 is interrupted by a recess 107 which receives a flexible sealing gasket means 108 therein which is adapted to be secured in the recess 107 in any suitable manner, such as by adhesive means or the like, and is provided with a projecting portion 109 which is adapted to sealingly engage against the projecting portion 109 of the adjacent gasket means 108 of the adjacent holddown bar 100 of the adjacent hatch cover 33C as illustrated in FIG. 20 so as to completely seal the space between the adjacent ends 104 of the adjacent hatch covers 33C while the same are disposed in their closed condition.

Figure 21:
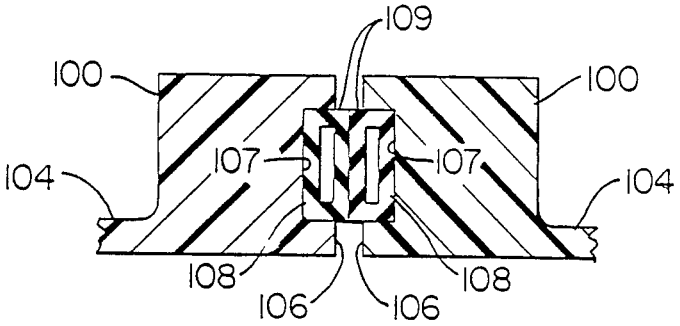
FIG. 21 is a view similar to FIG. 20 and illustrates the hatch cover arrangement in another operating condition thereof.

While the gasket means 108 illustrated in FIG. 20 are shown as being substantially D-shaped in cross section, it is to be understood that the same could have other configurations as the important feature is that the projecting portions 109 thereof are adpated to seal against each other and also take up any reasonable change in the spacing that may exist between the facing sides 106 of the hatch covers 33C so that the spacing therebetween does not have to be exactly of a specified distance but should be in a range that permits the projecting portions 109 to seal against each other either in the manner illustrated in FIG. 20 when the holddown bars 100 are spaced apart the greatest distance thereof or when the same are disposed closely adjacent each other as illustrated in FIG. 21.

In any event, it can be seen that by having each gasket means 108 carried by its respective holddown bar 100, each hatch cover 33C could be opened relative to the other hatch cover 33C and when subsequently closed, will again seal against the gasket means 108 of the already closed hatch cover 33C in the manner previously set forth.

As illustrated in FIG. 17, the same latch means 46C can be provided for the adjacent holddown bars 100 of the adjacent hatch covers 33C so that the single latch bar 103 will extend across both adjacent latch toes 82C to hold the holddown bars 100 in their closed condition as illustrated in FIGS. 17 and 20.

Figure 19:
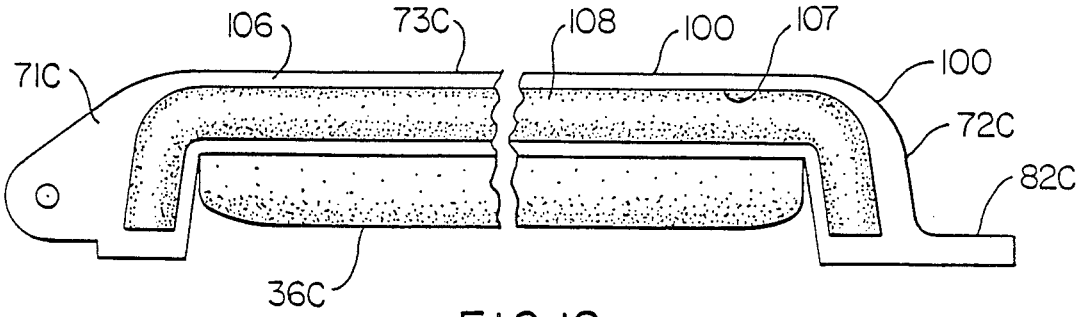
FIG. 19 is a fragmentary cross-sectional view taken on line 19—19 of FIG. 17.

As illustrated in FIG. 19, the gasket means 108 for each holddown bar 100 can extend all the way along the medial portion 73C thereof and into the opposed ends 71C and 72C as illustrated.

While the gasket means 108 for each holddown bar 100 has been previously illustrated and described as being substantially D-shaped in cross section so as to have the projecting arcuate portions 109 thereof engage against each other as illustrated in FIGS. 20 and 21, it is to be understood that the gasket means could have additional configurations to further assure the sealing effect therebetween.

Figure 22:
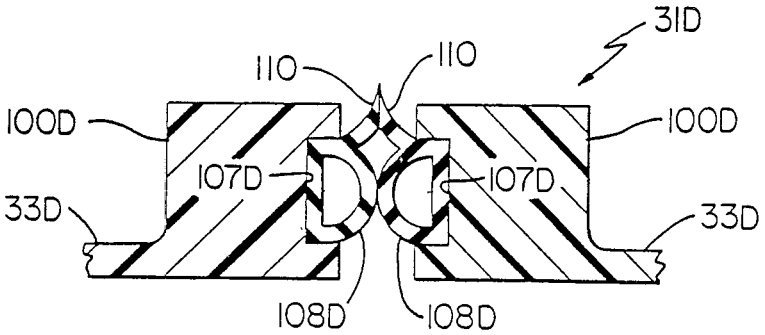
FIG. 22 is a view similar to FIG. 20 and illustrates another embodiment of the hatch cover arrangement of this invention.

For example, reference is made to FIG. 22 wherein another embodiment of the hatch cover means of this invention is generally indicated by the reference numeral 31D and parts thereof similar to the hatch cover means 31C of this invention previously described are indicated by like reference numerals followed by the reference letter "D".

As illustrated in FIG. 22, the holddown bars 100D of each hatch cover 33D is substantially the same as the holddown bar 100 previously described and the same respectively carry gasket means 108D in the recesses 107D thereof with the gasket means 108D being substantially D-shaped in cross section. However, the gasket means 108D each has an additional lip or extension 110 which will engage against the like extension 110 on the adjacent gasket means 108D as illustrated in FIG. 22 to further seal the gasket means 108D together when the hatch covers 33D are disposed in their closed condition as illustrated in FIG. 22.

In addition, it is to be understood that a single gasket means can be carried by one of the adjacent holddown bars 100 and seal against the face 106 of the other of the adjacent holddown bars 100, if desired.

Therefore, it can be seen that the hatch means 31C or 31D of this invention are adapted to be formed by molding suitable polymeric material, such as the material that normally forms the hatch covers 33 previously described, to form the hatch cover and the integral holddown bars 100, 101 and 102 in the configuration illustrated in the drawings whereby the holddown bars 100, 101 and 102 form the structural holddown portions of the respective hatch cover 33C when the same are hinged to the hinge means 43C by the pivot pins 42C extending through the openings 80C in the ends 71C thereof, the other ends 72C of the holddown bars 100, 101 and 102 permitting the latch means 46C to latch the latch toes 82C thereof in the closed condition as previously set forth.

In this manner, each hatch cover 33C has at least one holddown bar 100, 101 and 102 being formed as a one-piece homogeneous member therewith as the hatch cover 33C and the holddown bar 100, 101 and/or 102 are formed of the same polymeric material.

In this manner, the integral holddown bars 100, 101 and 102 can provide the sole hinging means for interconnecting the respective hatch cover 33C to the railroad car 32C in the manner previously set forth.

Accordingly, it can be seen that this invention not only provides an improved hatch cover means or arrangement and method of making the same, but also this invention provides a railroad car utilizing such improved hatch cover means or arrangement.

While the forms and methods of this invention now preferred have been illustrated and described as required by the Patent Statute, it is to be understood that other forms and method steps can be utilized and still fall within the scope of the appended claims.

What is claimed is:

1. In a combination of a hatch cover for a railroad car and a holddown bar for said hatch cover, said hatch cover having opposed ends, said holddown bar having opposed ends one of which is adapted to be pivotally mounted to said car and the other of which is adapted to be releasably latched to said car while a medial portion thereof intermediate said opposed ends extends transversely across said hatch cover, the improvement wherein said holddown bar and said hatch cover comprise a one-piece homogeneous member formed of polymeric material, said holddown bar being disposed at one of said opposed ends of said hatch cover and having a flat end face that is disposed substantially transverse to said hatch cover, said end face carrying a gasket for sealing to an adjacent hatch cover and holddown bar combination when the two combinations are in the closed condition thereof.

2. A combination as set forth in claim 1 wherein said hatch cover has another holddown bar that is disposed intermediate said opposed ends of said hatch cover and is homogeneous therewith.

3. A combination as set forth in claim 1 wherein said hatch cover has another holddown bar that is disposed at the other of said opposed ends of said hatch cover and is homogeneous therewith.

4. A combination as set forth in claim 3 wherein said other holddown bar has a rain shield that tends to protect said other end of said hatch cover from the elements.

5. A combination as set forth in claim 1 wherein said flat end face has an opening therein, said gasket having a portion thereof disposed in said opening.

6. A combination as set forth in claim 5 wherein said gasket has a generally D-shaped transverse cross-sectional configuration with the arcuate portion thereof extending outwardly beyond said flat end face.

7. A combination as set forth in claim 6 wherein said gasket has a lip extending outwardly beyond said arcuate portion thereof.

* * * * *

UNITED STATES PATENT AND TRADEMARK OFFICE

CERTIFICATE OF CORRECTION

PATENT NO. : 4,840,126

DATED : June 20, 1989

INVENTOR(S) : Donald L. Kleykamp

It is certified that error appears in the above-identified patent and that said Letters Patent is hereby corrected as shown below:

On the title page Insert

--[73] Assignee: Dayco Products, Inc., Dayton, Ohio--

Signed and Sealed this

Third Day of July, 1990

*Attest:*

HARRY F. MANBECK, JR.

*Attesting Officer*

*Commissioner of Patents and Trademarks*